US008753217B2

(12) United States Patent
Seong

(10) Patent No.: US 8,753,217 B2
(45) Date of Patent: Jun. 17, 2014

(54) APPARATUS FOR CORRECTING A HEAD-UP PHENOMENON DURING A GOLF SWING

(76) Inventor: Jang Yeon Seong, Seoul (KR)

( * ) Notice: Subject to any disclaimer, the term of this patent is extended or adjusted under 35 U.S.C. 154(b) by 0 days.

(21) Appl. No.: 13/642,493

(22) PCT Filed: May 26, 2010

(86) PCT No.: PCT/KR2010/003336

§ 371 (c)(1),
(2), (4) Date: Oct. 19, 2012

(87) PCT Pub. No.: WO2011/132816

PCT Pub. Date: Oct. 27, 2011

(65) Prior Publication Data

US 2013/0035171 A1 Feb. 7, 2013

(30) Foreign Application Priority Data

Apr. 19, 2010 (KR) ..... 10-2010-0036060

(51) Int. Cl.

| | |
|---|---|
| ***A63B 69/36*** | (2006.01) |
| ***A63B 24/00*** | (2006.01) |
| ***A63B 57/00*** | (2006.01) |

(52) U.S. Cl.

CPC ..... *A63B 24/0006* (2013.01); *A63B 57/0006* (2013.01); *A63B 69/3623* (2013.01); *A63B 2220/30* (2013.01); *A63B 2024/0012* (2013.01); *A63B 2225/055* (2013.01)

USPC ..... 473/133; 473/134; 473/135; 473/136; 473/219

(58) Field of Classification Search

CPC .. A63B 24/003; A63B 24/006; A63B 57/006; A63B 69/36; A63B 69/3623; A63B 2220/30; A63B 2024/0012; A63B 2225/055

USPC ..... 473/133–136, 219

See application file for complete search history.

(56) References Cited

U.S. PATENT DOCUMENTS

| | | | | |
|---|---|---|---|---|
| 3,895,366 | A * | 7/1975 | Morris | 340/870.26 |
| 4,181,309 | A * | 1/1980 | Atkinson et al. | 473/136 |
| 5,549,299 | A * | 8/1996 | Brown | 473/133 |
| 6,602,144 | B2 * | 8/2003 | Manwaring et al. | 473/198 |
| 8,449,401 | B2 * | 5/2013 | Kayama | 473/210 |
| 2011/0250981 | A1 * | 10/2011 | Choi | 473/225 |

FOREIGN PATENT DOCUMENTS

| | | |
|---|---|---|
| JP | 2009-279126 | 12/2009 |
| KR | 10-0486019 | 4/2005 |
| KR | 20-0383094 | 4/2005 |
| KR | 10-0679465 | 2/2007 |

OTHER PUBLICATIONS

International Search Report for PCT/KR2010/003336 Mailed on May 24, 2011.

* cited by examiner

*Primary Examiner* — Dmitry Suhol
*Assistant Examiner* — David Duffy
(74) *Attorney, Agent, or Firm* — AKC Patents LLC; Aliki K. Collins

(57) ABSTRACT

The present invention relates to an apparatus for correcting a head-up phenomenon during a golf swing, and more specifically to an apparatus for correcting a head-up phenomenon during a golf swing, which helps a golfer keep his or her eyes on the place where a golf ball to be struck is located, by making the ball ascend just before the impact only if the swing speed exceeds a pre-set value. According to the apparatus for correcting a head-up phenomenon especially during the golf tee-shot training, a golf ball either ascends above the ground or descends toward the ground from above just before the impact only if a down-swing is performed or only if the swing speed exceeds the pre-set value, such that the user may not suffer too much burden when swinging the golf ball placed on the tee. As such, during the golf tee-shot training the present invention is able to avoid the head-up phenomenon or correct the head-up habit by stopping the golfer from looking away from the place where a golf ball to be struck is located, by making the ball just before the impact only if the swing speed exceeds the pre-set value. In addition, even if the swing speed exceeds the pre-set value, the golf ball would not ascend or would descend from above just before the impact, such that the golfer can keep looking at the striking site till the last moment, thereby avoiding the head-up phenomenon and correcting the head-up habit.

11 Claims, 10 Drawing Sheets

APPARATUS FOR CORRECTING A HEAD-UP PHENOMENON DURING A GOLF SWING

RELATED APPLICATIONS

This application is a 371 application of International Application No. PCT/KR2010/003336, filed May 26, 2010, which in turn claims priority from Korean Patent Application Nos. 10-2010-0036060, filed Apr. 19, 2010, each of which is incorporated herein by reference in its entirety.

TECHNICAL FIELD

The present invention relates to an apparatus for correcting a head-up phenomenon during a golf swing, and more specifically, an apparatus, which makes a golf ball either ascend above a ground or descend toward the ground from above just before the impact only if a down-swing is performed or a swing speed exceeds a pre-set value during the golf tee-shot training, such that the golfer may not suffer too much burden, the burden occurring due to a golf ball placed on the tee during a swing.

BACKGROUND ART

Generally, golf is a game that is played by striking a golf ball to a green to sink it into a hole-cup placed a certain distance apart from where the golf ball is struck, and golf is a record game, and thus, a golfer who sinks a golf ball into a hole-cup with the smallest number of strokes becomes a winner.

The most important things in golf are a distance of a shot and an accuracy of a shot. If a distance is good and a shot is accurate, the number of strokes may be reduced, and thus, every golfer practices for the distance of a shot and the accuracy of a shot.

However, even if a golfer know thoroughly knows a pose, which has to be maintained just before a swing and an impact so as to improve a distance of a shot and an accuracy of a shot, if a golfer does not correct a head-up habit by which a head of a golfer ascends before an impact, improvement of the distance of a shot and the accuracy of a shot is impossible.

This bad habit is seldom corrected, and it is impossible to keep a good score without correcting the bad habit.

This phenomenon occurs usually to a pro player as well as non-pro players (i.e., the general public), and thus, to avoid the bad habit, an intensive training for avoiding the head up is performed, and an assistive device for avoiding the head up or a device for a posture correction is used.

However, because there are many regulations which do not allow a golfer to use the assistive device during a golf round, the assistive device is not well used, and because the device for the posture correction used in a golf training cannot be used in a golf rounding, a golfer familiar to use the device sometimes does not get a good result.

Therefore, to improve a distance of a shot and an accuracy of a shot, a golfer has to repeatedly practice to correct the head-up habit.

DISCLOSURE OF INVENTION

Accordingly, the present invention is directed to provide an apparatus for correcting a head-up phenomenon during a golf swing that substantially obviates one or more problems due to limitations and disadvantages of the related art. An aspect of the present invention is directed to provide an apparatus for correcting a head-up phenomenon during a golf swing, which makes a golf ball either ascend above a ground or descend toward the ground from above just before the impact if a down-swing is performed or a swing speed exceeds a pre-set value during the golf tee-shot training, and places a golf ball during a down-swing process instead of placing a golf ball from an addressing time, and therefore, enables a golfer not to suffers a burden occurring because of placing a golf ball from an addressing time and enables a golfer not to raise a head.

To achieve these and other advantage and in accordance with the purpose of the invention, as embodied and broadly described herein, there is provided an apparatus for correcting a head-up phenomenon during a golf swing, which keeps a golf ball inside a ground not to be seen before a down-swing, makes a golf ball ascend above a ground or descend toward the ground after the ascent, adjusts an ascending or descending interval and an ascending or descending time according to a pre-set value, and makes a golf ball randomly descend or maintains an ascending state if a motion of swinging a golf club is checked after ascending.

ADVANTAGEOUS EFFECTS

According to the embodiments, the present invention maintains nothing on a tee during an addressing time by making a golf ball ascend above a ground just before the impact only if a down-swing is performed or a swing speed exceeds a pre-set value during the golf tee-shot training, and therefore, makes a golfer not need to raise a head and makes a golfer correct a head-up habit.

Moreover, the present invention makes a golfer to keep looking at the striking site till the last moment by making a golf ball not ascend or making a golf ball, which already ascends, descend just before an impact even if a swing speed exceeds a pre-set value, thereby preventing a head of a golfer from being raised and making a golfer correct a head-up habit.

BRIEF DESCRIPTION OF DRAWINGS

The accompanying drawings, which are included to provide a further understanding of the invention and are incorporated in and constitute a part of this application, illustrate embodiments of the invention and together with the description serve to explain the principle of the invention. In the drawings.

| Descriptions of reference numbers | | | |
|---|---|---|---|
| 10: | apparatus for correcting a head-up phenomenon | | |
| 11: | operation unit | | |
| 11a: | swing-speed set button | 11b: | height set button |
| 11c: | motion set button | 11d: | display means |
| 12: | swing speed/swing range detection unit | | |
| 12a: | speedometer | | |
| 12b: | position sensor | 13: | golf-ball sensing unit |
| 14: | control unit | 14a: | comparative unit |
| 14b: | set processing unit | 14c: | driver |
| 15: | lift driving unit | 151a: | motor |
| 151b: | path set part | 151c: | lifting means |
| 151d: | lift support part | 151e: | operation support part |
| 151f: | operation hinge | 151g: | operation link |
| 152a: | spur gear | 152b: | rack gear |
| 16: | golf-ball locking unit | 16a: | guide rail |
| 16b: | bracket | 16c: | tee |
| 16d: | vacuum | 17: | hole-blocking member |
| 18: | power supply unit | 1: | golf-ball |
| 2: | grass mat | 3: | hole |

MODES FOR CARRYING OUT THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

The present invention is an apparatus for correcting a head-up phenomenon during a golf swing, which keeps a golf ball inside a ground not to be seen if a swing speed is equal to or lower than a predetermined velocity, makes a golf ball ascend above the ground just before the impact if a swing speed is equal to or higher than the predetermined velocity, adjusts an lifting interval and an ascending time of a golf ball according to a predetermined value, and makes a golf ball randomly descend or maintains an ascending state if a motion of swinging a golf club is checked after ascending.

Figure 1:
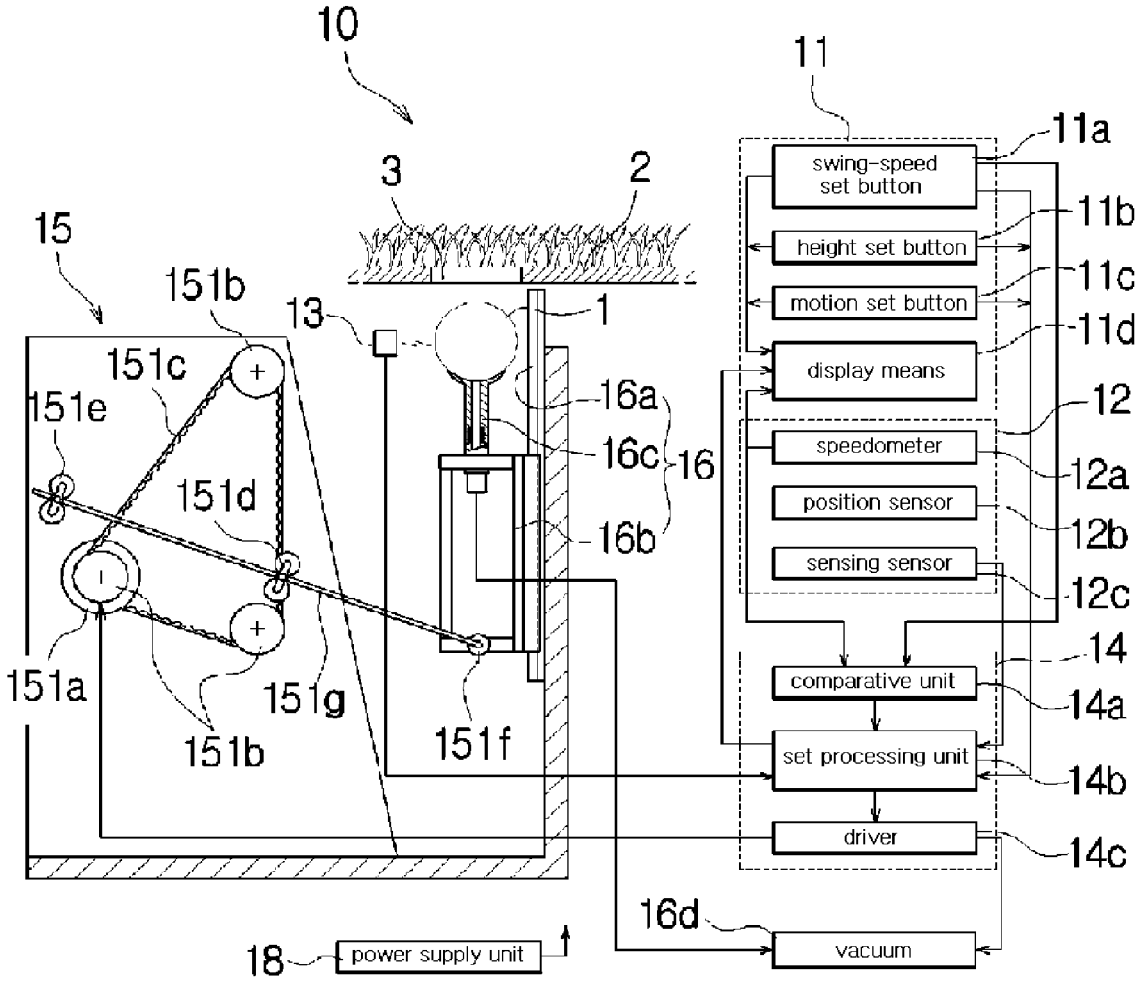
FIG. 1 is a sectional view illustrating a configuration according to an embodiment of a present invention, and more particularly, illustrating a golf ball which is an initial state under a ground.

To describe more detail, the present invention, as shown in FIG. 1, may include an operation unit 11 which beforehand sets a maximum of a swing speed of a club, a lifting position of a golf ball, and an lifting interval and an lifting time of a golf ball by operating a button; a swing speed/swing range detection unit 12 which senses a golf club being swung to detect a velocity of the golf club and senses whether the golf club proceeds to a target tee to detect a motion of the golf club; a golf-ball sensing unit 13 which senses whether a golf ball is placed on a tee 16*a*; a control unit 14 which compares the maximum of the swing speed set by the operation unit 11 with a real swing speed of the golf club detected by the swing speed/swing range detection unit 12, outputs a moving signal of a lift driving unit 15, a moving signal of a golf-ball locking unit 16 and a lifting interval and an ascending time signal of a golf ball depending on a predetermined value or a random value if the real swing speed is equal to or higher than the maximum of the swing velocity, and make an ascending golf ball descend if a swing range of a real golf club detected by the swing speed/swing range detection unit 12 gets out of a set range of a an up, down, left and right direction of a target tee; the lift driving unit 15 which makes the golf-ball locking unit 16 ascend or descend according to a signal transferred from the control unit 14; the golf-ball locking unit 16 which sucitions a golf ball 1 to prevent the ascending golf ball from falling; and a power supply unit 18 which supplies power to each of the units.

Figure 2:
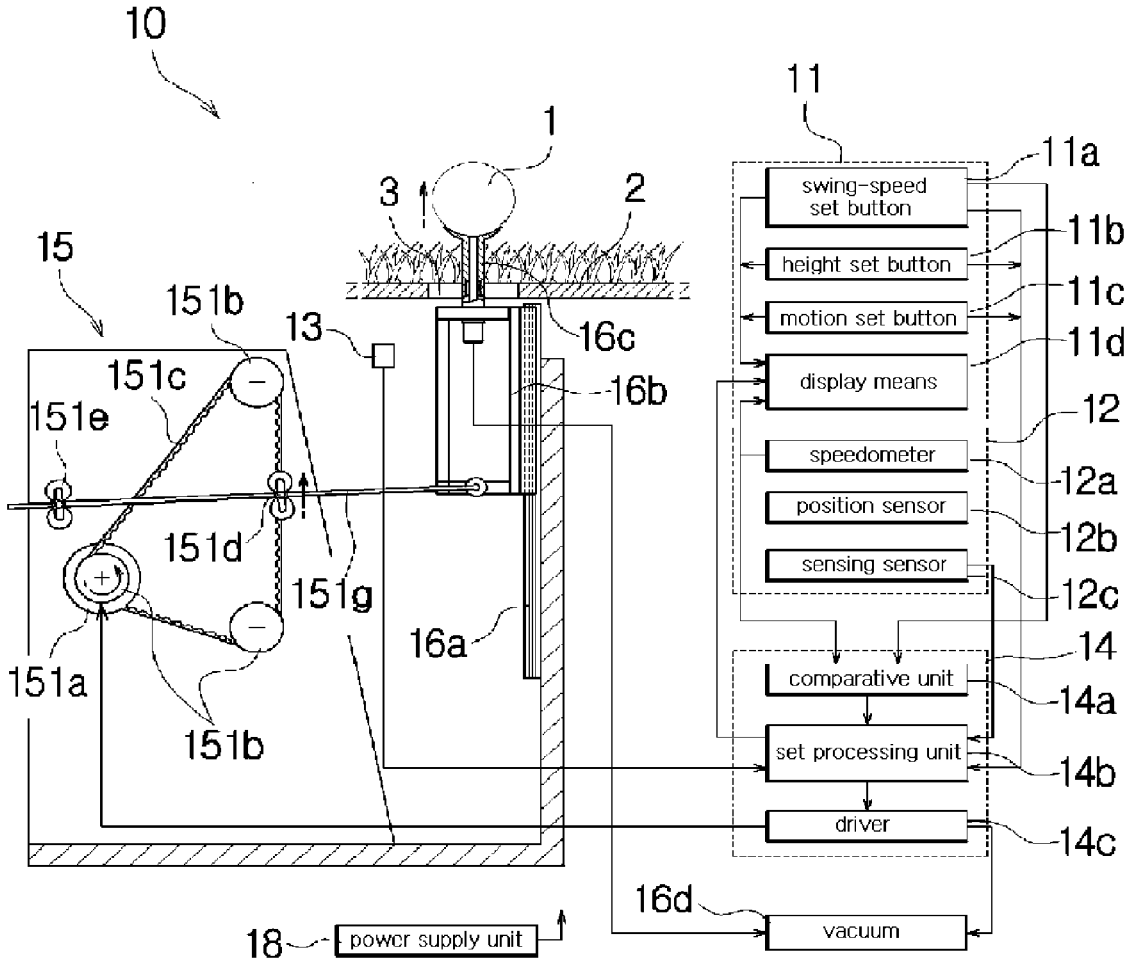
FIG. 2 is a sectional view illustrating a configuration according to an embodiment of the present invention, and more particularly, illustrating an ascending golf ball.
Figure 3:
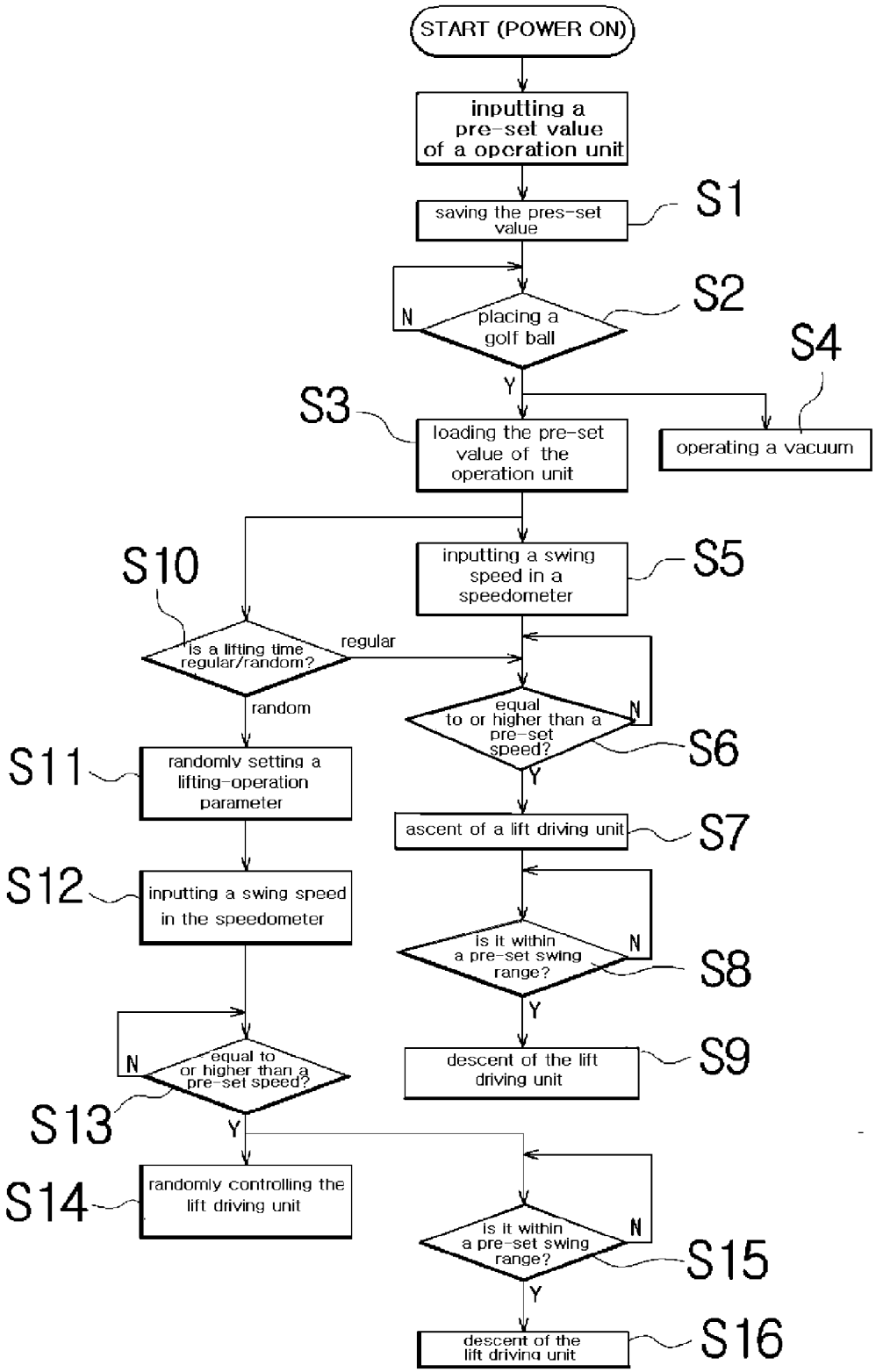
FIG. 3 is a flowchart illustrating a controlling step performed by a control unit according to an embodiment of the present invention.

The detail configuration of each of the units forming the present invention is as shown in FIGS. 2 and 3.

First, the operation unit 11 may include a swing-speed set button 11*a* which increases or decreases the maximum of the swing speed and the swing range to transfer an increased-or-decreased set value to the control unit 14, a height set button 11*b* which adjusts a lift height of a golf ball to transfer an adjusted signal to the control unit 14; a motion set button 11*c* which sets the lifting interval and the lifting time of the golf ball randomly or regularly to transfer a set signal to the control unit 14; and a display means 11*d* which displays a operated state and a motion state of the buttons.

The display means 11*d* may be a liquid crystal display device LCD which receives electric signals of each of the buttons to convert the signals to digital signals and displays the swing speed of the golf club detected by the swing speed/swing range detection unit 12.

The swing speed/swing range detection unit 12 of the present invention may include a speedometer 12*a* which senses a swing motion of a golf club at a front side or a rear side of a body of a golfer to calculate a velocity by using a distance by which a golf club moves and a time for which the golf club moves; a position sensor 12*b* which is placed in a rear side of a swing direction of the golf club and senses whether the golf club proceeds inside the set range of a an up, down, left and right direction of a golf ball 1; and a sensing sensor 12*c* which senses whether or not a golfer is.

The speedometer 12*a* of the swing speed/swing range detection unit 12 may be placed in a front side of a back-swing trajectory of a golfer and measure a swing speed of a club by using times from a back-swing till an impact.

Moreover, the position sensor 12*b* is a sensor which detects positions generated by a swing of the golf club about the golf ball 1 placed on the tee 16*c*.

The golf-ball sensing unit 13 of the present invention may be a proximity sensor which is placed in one side of the tee 16*c*, on which the golf ball is placed, at an interval, may be a weight sensor which senses a weight variation depending on an existence of the golf ball 1 on the tee 16*c* to sense whether or not the golf ball is, may be an illuminance sensor such as a CDS sensor which senses a light and shade of an ambient depending on an existence of the golf ball 1 on the tee 16*c* to sense whether or not the golf ball is, or may be a sensor which consists of the proximity sensor, the weight sensor and the illuminance sensor.

The control unit 14 of the present invention may be a microprocessor or a program built in a microprocessor which includes a comparative unit 14*a* which compares the maximum of the swing speed set by the operation unit 11 with a real swing speed of the golf club detected by the swing speed/swing range detection unit 12; a set processing unit 14*b* which outputs an moving signal of a golf-ball locking unit 16 depending on a lifting interval and a lifting time of the golf ball, the lifting interval and the lifting time being set by the operation unit 11 and gathers detection signals of the comparative unit 14*a* to output a moving signal beforehand set for corresponding to the gathered detection signal; and a driver 14*c* which outputs moving signal of the lift driving unit 15 and the golf-ball locking unit 16 according to a signal outputted from the comparative unit 14*a*.

The comparative unit 14*a* may be a comparative circuit comprising 0P Amp which compares a set reference value with a inputted detection signal to determine whether the detection signal is equal to or higher than the reference value or the detection signal is equal to or lower than the reference value.

The set processing unit 14*b* may be a microprocessor or a program built in a microprocessor which makes the golf ball locking unit 16 ascend if the comparative unit 14*a* detects a real swing speed equal to or higher than the maximum of the swing speed set by the operation unit 11, and makes the golf ball locking unit 16 descend if the comparative unit 14*a* detects a real swing range getting out of the beforehand set range. That is, the microprocessor or the program may output a predetermined moving signal depending on the gathered detection signals. Moreover, the microprocessor or the program may output a moving signal of the lift driving unit 15 and the golf-ball locking unit 16 depending on the lifting interval and the lifting time of the golf ball even if the comparative unit 14*a* detects a real swing speed equal to or higher than the maximum of the swing speed set by the operation unit 11, the lifting interval and the lifting time being set and received by the operation unit 11.

The lift driving unit 15 of the present invention includes a motor 151*a* which rotates forward and backward according to a control signal transferred from the control unit 14; a lifting means 151*c* which moves forward and backward according to a rotation of the motor 151*a* in the state that the lifting means 151*c* forms a closed path by being connected to a path set part 151*b* coupled to a rotational shaft of the motor 151*a* and to another path set part 151*b* located at one position or two path set part 151*b* located at two position vertically to a ground; a lift support part 151*d* which is connected to both sides of a bracket, which is fixed in a side of a vertical and straight path of the lifting means 151*c* by a shaft, at certain intervals; an operation support part 151*e* which is connected to both sides of a bracket, which is placed in a side direction of the lift support part 151*d*, at certain interval; an operation hinge 151*f* which is coupled to a lower portion of the golf-ball locking unit 16 by a shaft; and an operation link 151*g* one end of which is formed integrally with the operation hinge 151*f* or connected to the operation hinge 151*f*, a middle portion of which passes through the lift support part 151*d* and is supported by the lift support part 151*d*, the other end of which passes through the operation support part 151*e* and is supported by the operation support part 151*e* and which is formed in a boar shape or a bar shape.

Here, the motor 151*a* rotates forward and backward according to a signal outputted from a driver 14*c* of the control unit 14. A forward and backward rotation of the motor 151*a* may be restrictively driven so as to stop at a lift-limited position of the golf-ball locking unit 16, or a motion of the motor 151*a* may be limited by a sensor located at the lift-limited position.

The path set part 151*b* may be any one of a pulley, a pinion and a chain gear.

The lifting means may be timing belt or a chain.

The lift support part 151*d* may include a shaft fixed at a side of a path, which is parallel with a vertical and straight path of the lifting means 151*c*, that is, a lift path of the golf-ball locking unit 16, at certain intervals; a bracket formed in one end portion of the shaft; a through hole being formed in a center portion of the bracket; and a pair of bearings coupled to both sides of the bracket at certain intervals.

The operation support part 151*e* may include a shaft fixed to a upper portion of a wall in which the motor 151*a* is fixed; a bracket formed in one end portion of the shaft; a through hole being formed in a center portion of the bracket; and a pair of bearings coupled to both sides of the bracket at certain intervals.

The operation hinge 151*f* may be any one of a pin, a ring and a bearing which are formed in one end portion of the operation link 151*g*.

The golf-ball locking unit 16 of the present invention may include a guide rail 16*a* which is mounted on a wall vertically to a ground; a bracket 16*b* which is guided by the guide rail 16*a* to ascends or descends by a ascending force or a descending force transferred from the lift driving unit 15; a center pass-shaped tee 16*c* which is fixed to an upper portion of the bracket 16*b*; and a vacuum (a vacuum pump) 16*d* which is connected to a lower portion of the tee 16*c* through a hose and suctions the outside air through a center through hole formed in a center portion of the tee by using a vacuum, the outside air being suctioned from a side in which the golf ball 1 is placed.

The power supply unit 18 may be a constant-voltage power supplier comprising a voltage stabilizer which converts an alternating current AC to a direct current DC to transfer a driving power to the control unit 14 and each of the units.

An operating method of the present invention described above will be provided below.

First, if the sensing sensor 12*c* senses a motion when a golfer is coming into a position of the operation unit 11 or a position for training, or a power switch is turned on, the sensing sensor 12*c* transfers a sensing signal to the control unit 14, thereby the present invention being operated.

In this case, if the maximum of the swing speed is increased or decreased to be set by operating the swing-speed set button 11*a* of the operation unit 11, an increased-or-decreased set value is transferred to the control unit 14 to be saved.

Also, if a lift height of the golf ball is adjusted by operating the height set button 11*b* of the operation unit 11, an adjusted value is transferred to the control unit 14.

Also, if a lifting interval and the lifting time of the golf ball 1 are randomly or regularly set by operating the motion set button 11*c*, a set signal is transferred to the control unit 14 to be saved.

At this point, the lifting interval of the golf ball 1 means one cycle for which the golf ball ascend and descend. The lifting interval of the golf ball 1 means a start time, at which the golf ball regularly ascends or descends according to the lifting interval, at which the golf ball ascends by a golfer's back-swings, at which the golf ball descends when a back-swing is changed to a down-swing, at which the golf ball ascends just before an impact, or at which the golf ball again descends to prevent a strike from being performed. A lift of the golf ball 1 is randomly performed by the motion set.

Therefore, the present invention leads a golfer to check whether or not a golf ball is when the golfer is swinging fully.

Because a golf ball ascends above a ground or descends toward the ground from above just before the impact only if a down-swing is performed or a swing speed exceeds a pre-set value during the golf tee-shot training, the present invention basically prevents a golfer from suffering too much burden, the burden occurring due to a golf ball placed on the tee during a swing.

As described above, if the pre-set value for a motion is beforehand set by using the operation unit 11, a golf ball 1 is provided with the tee 16*c* (an apparatus for providing the golf ball is widely used, and therefore, a detail description is not provide). If the golf-ball locking unit 13 senses the golf ball provided with the tee 16*c* to transfer a sensing signal to the control unit 14, the control unit 14 operates the vacuum 16*d* of the golf-ball locking unit 16. The control unit 14 operates the lift driving unit 15, as shown in FIG. 2, for the golf ball 1 placed in the golf-ball locking unit 16 to ascend above a hole 3 of a grass mat 2 when the vacuum 16*d* is suctioning the golf ball 1 to prevent the golf ball from leaving the tee 16*c*.

Subsequently, if a golfer strikes a golf ball, the control unit 14 stops the vacuum 16*d* of the golf-ball locking unit 16 and rotates a cylinder 15*a* of the lift driving unit 15 to a reverse direction, thereby the golf-ball locking unit 16 descending under the hole 3 of the grass mat 2, that is, to the original position.

The detail description about the lift driving unit 15 will be provided below. If a driving signal is inputted from the driver 14*c* of the control unit 14 to the motor 151*a*, the motor 151*a* rotates forward to rotate the lifting means 151*c* in order for the golf-ball locking unit 16 to ascend, the lifting means 151*c* being coupled to the two or three pulleys used as the path set part 151*b*.

Then, the lift support part 151*d* coupled to the lifting means 151*c* makes the operation link 151*g* ascend about the operation support part 151*e*, and therefore, the other side of the operation link 151*g* ascends, thereby the golf-ball locking unit 16 coupled to the operation hinge 151*f* disposed at the other side of the operation link 151*g* ascending.

The golf-ball locking unit 16 ascending as described above expels the ball above the hole formed in the grass mat 2 when the golf-ball locking unit 16 is holding the golf ball by a vacuum-suction operation of the vacuum 16*d*.

Here, the golf ball 1 descends according to a descent of the lifting means 151*c*, the descent occurring by a backward rotation of the motor 151*a*. Also, a descent of the golf ball occurs by a backward operation of the above-described operation.

An operation of the control unit 14 controlling the above-described lifting operation of the golf ball will be described below with reference to FIG. 3.

In step S1, the control unit 14 saves a pre-set value if the pre-set value is set in the operation unit 11 by completion of every operation.

In this condition, if a golf-ball sensing signal is transferred from the golf-ball sensing unit 13 in step S2, the control unit 14 loads an lifting interval and an ascending time of a golf ball in step S3, operate the vacuum 16*d* of the golf-ball locking unit 16 in step S4, and outputs an operation signal so as to operate the lift driving unit 15.

At this point, the control unit 14 makes the golf ball ascend or descend according to the lifting interval of the golf ball 1. That is, as described above, the control unit 14 makes the golf ball regularly ascend or descend, makes the golf ball ascend by a golfer's back-swings, makes the golf ball descend when a back-swing is changed to a down-swing, makes the golf ball ascend just before an impact, or makes the golf ball again descend so as to prevent a strike from being performed, according to the lifting interval.

When the control unit 14 performs the control process, if a swing speed of a golfer is transferred from the speedometer 12*a* of the swing speed/swing range detection unit 12 in step S5, the control unit 14 determines whether the swing speed is equal to or higher than the pre-set swing speed in step S6. If the swing speed is equal to or lower than the pre-set swing speed, the control unit 14 keeps a stopped state of the lift driving unit 15, and if the swing speed is equal to or higher than the pre-set swing speed, the control unit 14 makes the lift driving unit 15 ascend in step S7.

At this point, if a swing range of the golf club is transferred from the position sensor 12*b* of the swing speed/swing range detection unit 12, the control unit 14 determines whether the swing range is within a pre-set swing range in step S8. If the swing range is within a pre-set swing range, the control unit 14 keeps a stopped state of the lift driving unit 15, and if the swing range is not within the pre-set swing range, the control unit 14 makes the lift driving unit descend in step S9.

In the step S3 of loading a pre-set value of the operation unit, the control unit determines whether the lifting time is regularly set or randomly set in step S10. If the lifting time is regularly set, the control unit performs the step S6 of determining the swing speed in the speedometer 12*a*, and if the lifting time is randomly set, the control unit randomly set a lifting-operation parameter of the lift driving unit 15 in step 11. Also, if a swing speed of a golfer is transferred from the speedometer 12*a* of the swing speed/swing range detection unit 12 in step 12, the control unit determines whether the swing speed corresponds to the pre-set swing speed in step 13. If the swing speed is equal to or lower than the pre-set swing speed, the control unit keeps the stopped state of the lift driving unit 15, and if the swing speed is equal to or higher than the pre-set swing speed, the control unit keeps the ascending state of the lift driving unit 15, or makes the lift driving unit 15 descend after making the lift driving unit 15 ascend, or keeps the descending state of the lift driving unit 15, according to the pre-set value which is randomly set, and then, in next operation, controls a random operation such as an ascent, in step S14. However, in this case, if a golf club gets out of the swing range (a moving range of a golf club in an up, down, left and right direction with respect to a golf ball), the control unit controls the lift driving unit 15 to descend in step 16.

Accordingly, even if a golfer swings fully, a golf ball 1 may be or may not be placed in the grass mat 2, that is, even if the swing speed is equal to or higher than a certain value, a golf ball may not ascend or may descend just before an impact after the golf ball ascend, according to the fact whether the swing speed corresponds to the pre-set swing speed. Therefore, the present invention leads a golfer to keep looking at the striking site till the last moment, thereby preventing a head of a golfer from being raised and making a golfer correct a head-up habit.

According to the control operation of the control unit 14, the present invention makes a golf ball 1 ascend or descend. For example, as shown in FIGS. 4 to 8, a golf training is performed when a golf ball is set so as to regularly ascend or descend.

Figure 4:
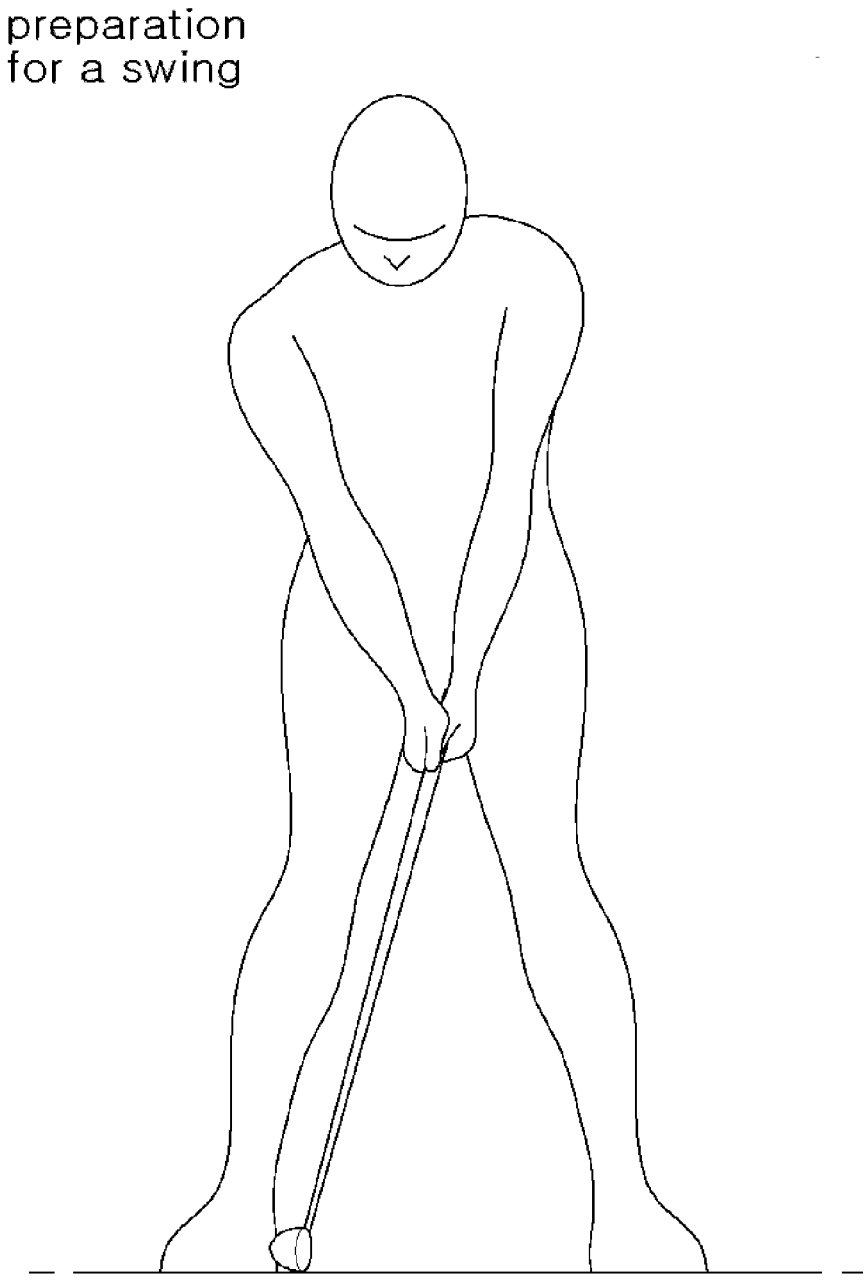
FIGS. 4 to 8 are schematic diagrams illustrating a step of training a shot by using an embodiment according to the present invention.
Figure 5:
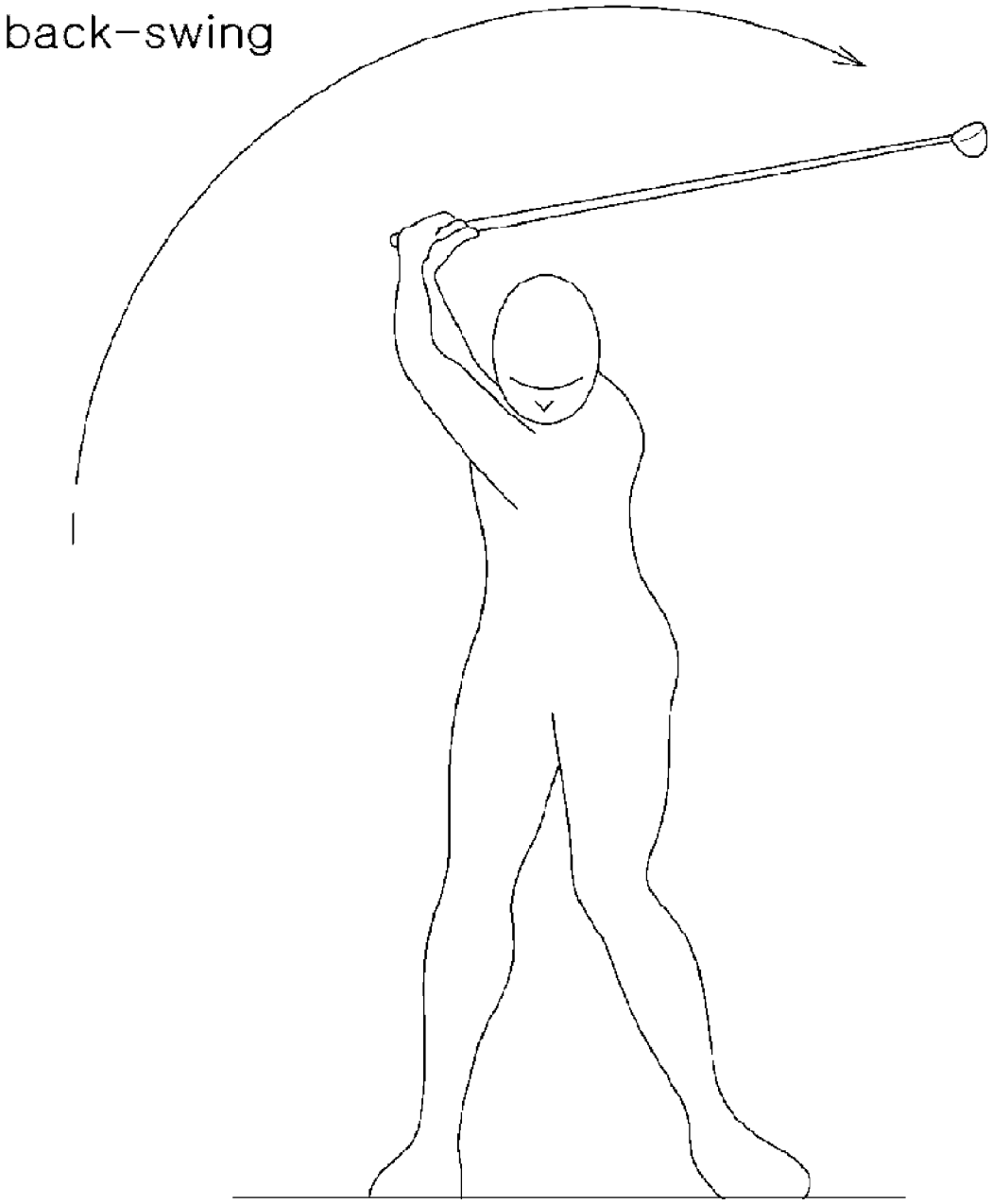

First, as shown in FIG. 4, a golfer stands for a swing at a tee-shot position, and then, swings as shown in FIGS. 5 to 8.

At this point, the swing may be a full swing for striking a golf ball 1, or may be a slow swing for maintaining a correct pose or selecting a striking position. This swing is sensed by the speedometer 12*a* of the swing speed/swing range detection unit 12, thereby the control unit 14 performing the above-described control operation.

Figure 6:
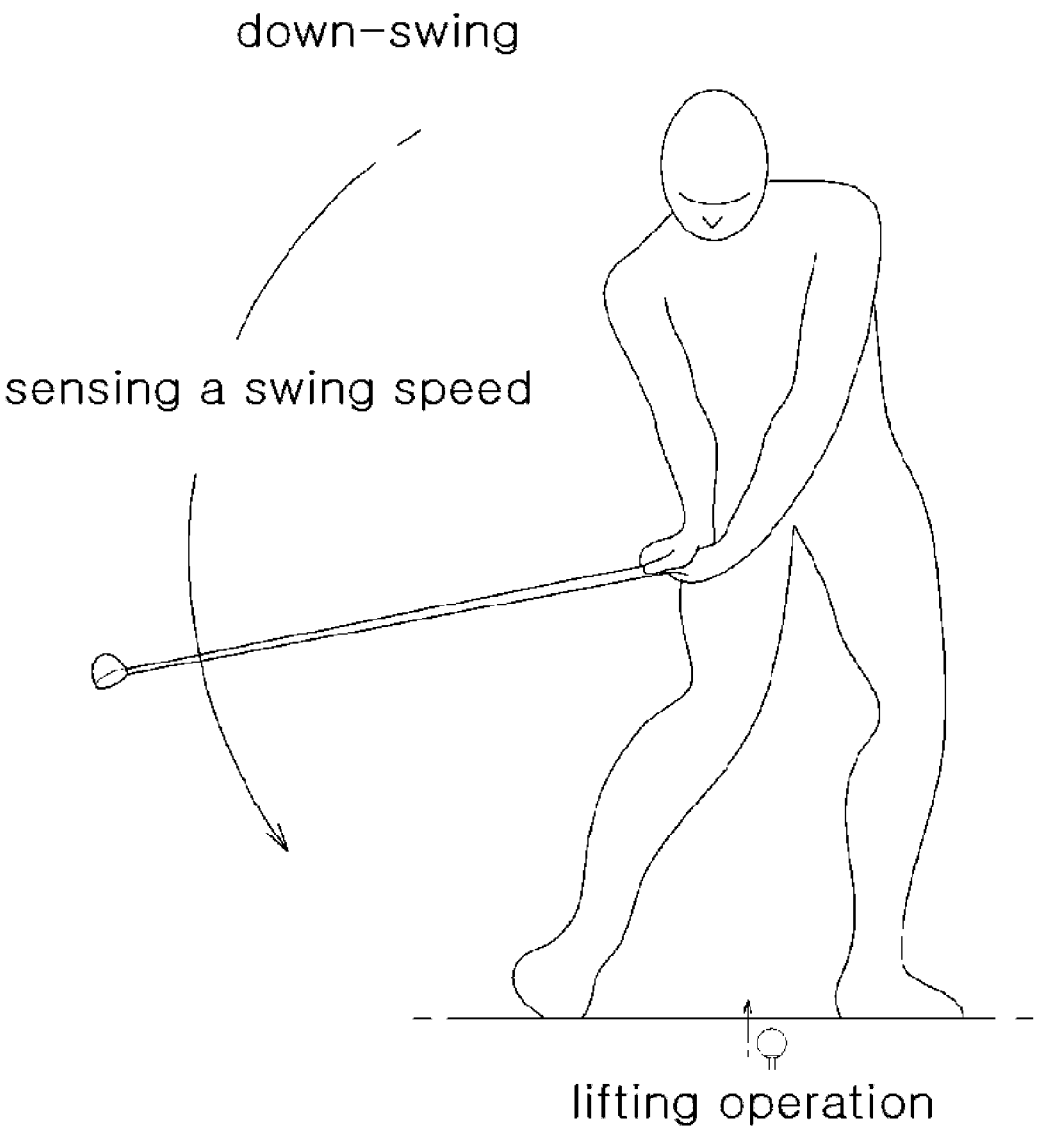

In this case, if the golfer's swing speed, which is equal to or higher than the pre-set swing speed, and thus, is guessed as a full swing, is sensed, the lift driving unit 15 is driven at a start time, in which a golfer's swing pose is the same as the pose shown in FIG. 6, to make the golf-ball locking unit 16 ascend. Here, the start time means a time immediately following a time when a swing-speed detection signal transferred from the swing speed/swing range 12 is inputted into the control unit 14.

Figure 7:
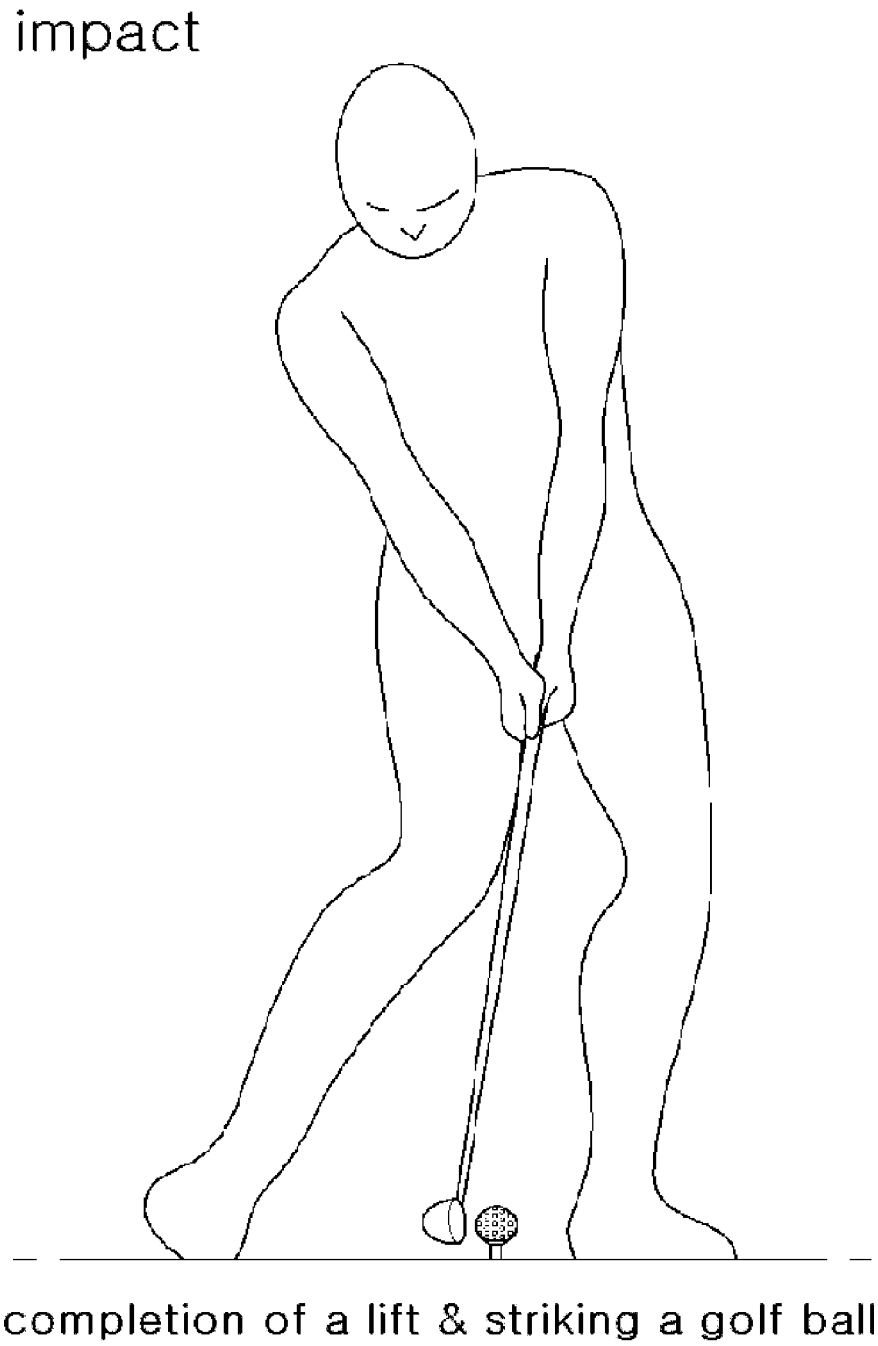

At this point, if the lift driving unit 15 is operated to make the golf-ball locking unit 16 ascend, as shown in FIG. 7, a golf ball placed on the tee 16*c* ascends above the grass mat 2 just before an impact, and thus, a golfer has to keep looking at the position, through which a golf ball ascends, till the impact. Here, the tee 16*c* may descend to be inserted into the grass mat 2 just after the tee 16*c* ascend above the grass mat, according to a set state.

Figure 8:
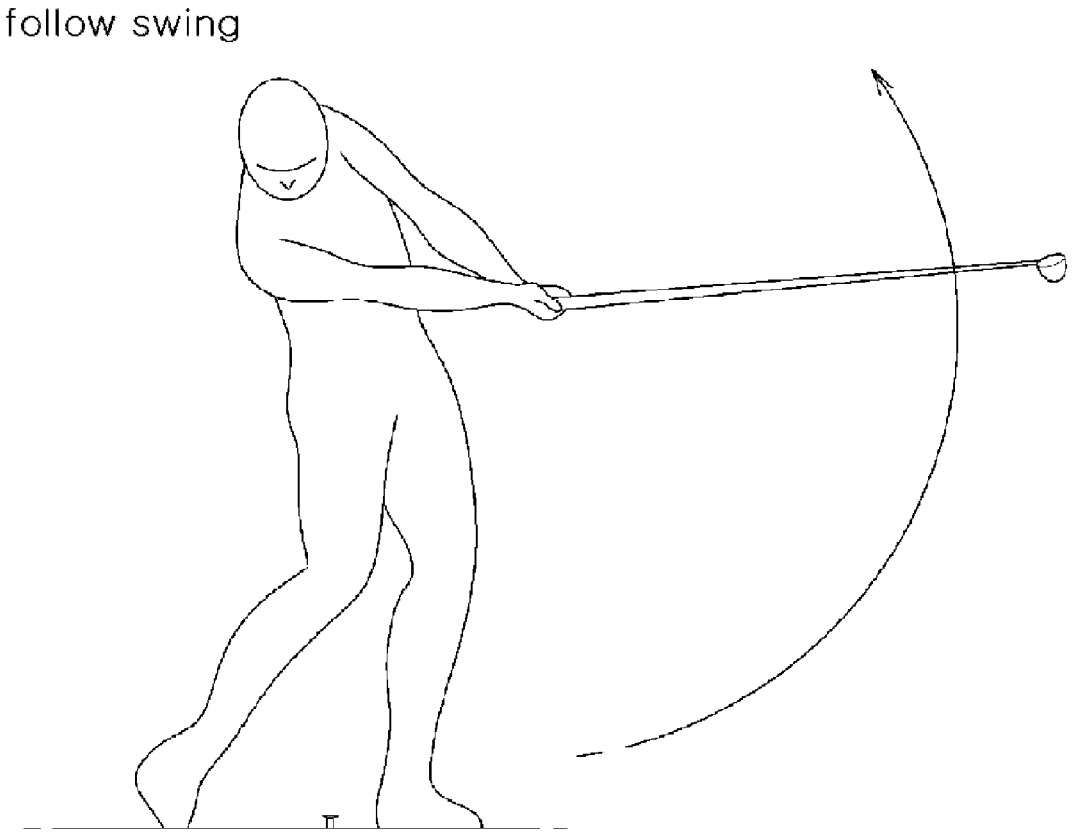

Therefore, just after a strike of a golf ball or a full swing without a golf ball, as shown in FIG. 8, a head-up phenomenon does not happen, and, after a follow swing is performed, a golfer turns a head toward a direction, to which a ball flies, to watch a ball.

As described above, the present invention helps a golfer keep his or her eyes on the place, in which a golf ball to be struck is located, by making a golf ball ascend above a ground just before the impact only if a swing speed exceeds a pre-set value during the golf tee-shot training, thereby a golfer avoiding the head-up phenomenon and correcting the head-up habit.

In addition, even if the swing speed exceeds the pre-set value, the golf ball would not ascend or would descend from above just before the impact, such that the golfer can keep looking at the striking site till the last moment, thereby a golfer avoiding the head-up phenomenon and correcting the head-up habit.

Another embodiment of the lift driving unit 15 may be applied to the present invention.

Figure 9:
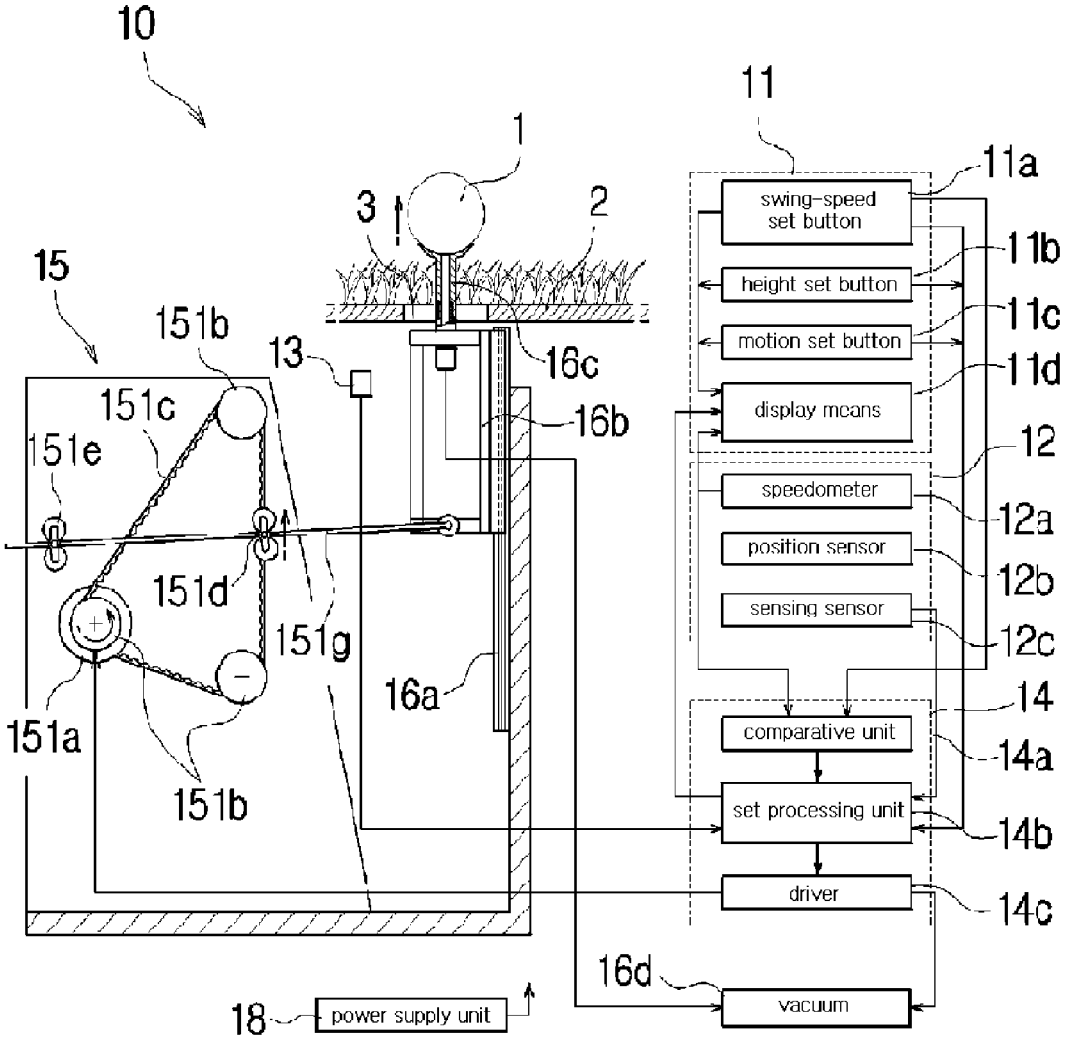
FIGS. 9 and 10 are sectional views illustrating a configuration according to another embodiment of the present invention.

As shown in FIG. 9, the lift driving unit 15 may include a spur gear 152*a* which is rotated by a motor, and a rack gear 152*b* which is mounted vertically to a ground in one side of the golf-ball locking unit 16 and meshes with the spur gear 152*a*.

Then, the rack gear 152*b*, which meshes with the spur gear 152*a* and includes a saw-tooth formed only in one side of a straight block, makes the golf-ball locking unit 16 ascend, according to an operation, the operation meaning that the motor, which rotates forward and backward according to a control signal transferred from the control unit 14 and is mounted on an internal wall of a board in which the grass mat 2 is spread, rotates the spur gear 152*a* forward and backward.

Figure 10:
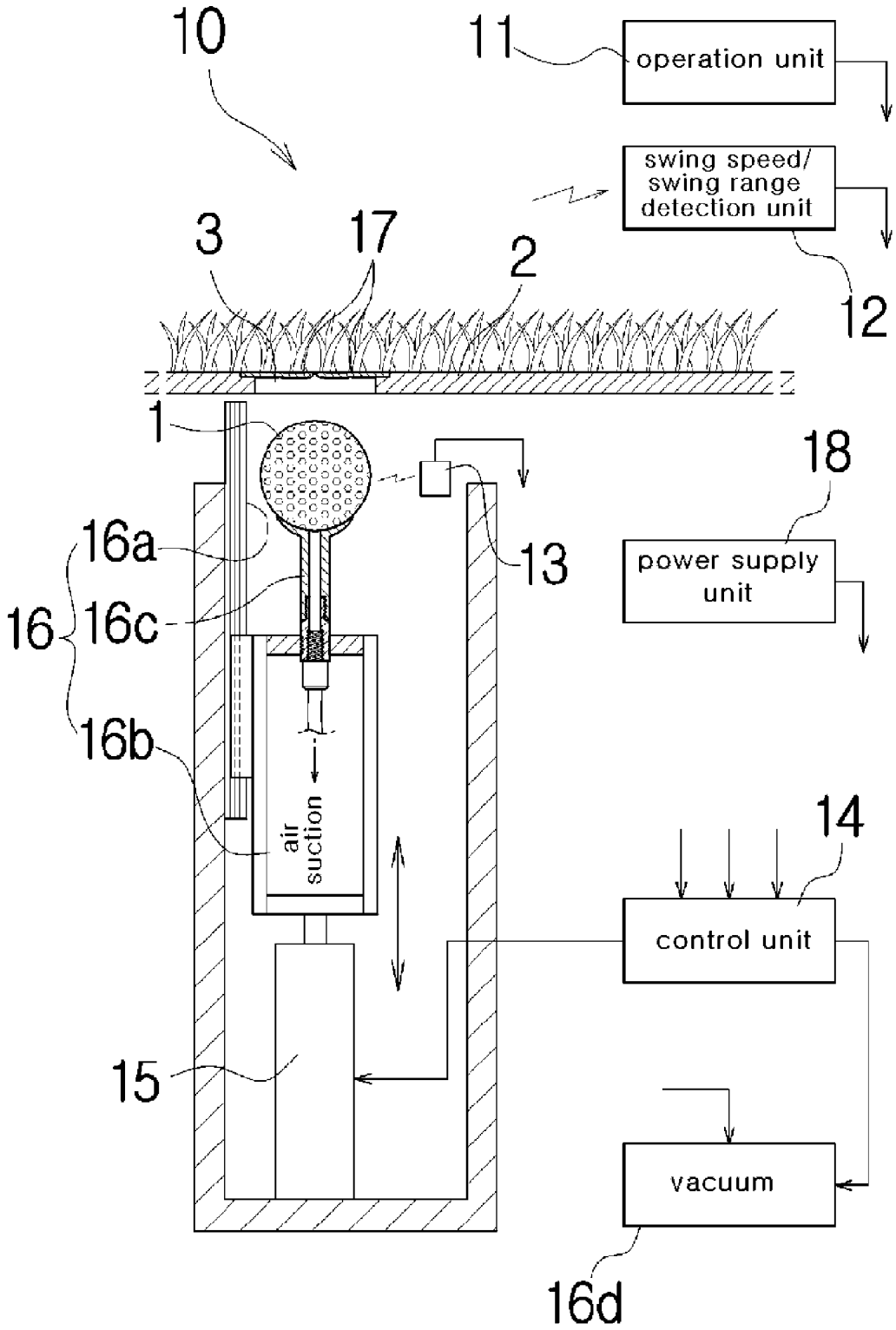

In another embodiment of the present invention, as shown in FIG. 10, the lift driving unit 15 may be a solenoid which generates a movement by using a current as a power and is used as an electro-dynamics apparatus. The solenoid may include a steel structure which covers a coil, and a column-shaped core grid which moves inside the steel structure and the coil.

The solenoid is placed just under the golf-ball locking unit 16, and makes the golf-ball locking unit 16 ascend according to an operation signal transferred from the control unit 14.

Also, as shown in FIG. 10, the present invention may further include a hole-blocking member 17 which is formed around the hole 3, through which a golf ball ascend or descend, to blocks the hole, and which is pushed by a ascending golf ball to open and is used as a cut blocking object.

The hole-blocking member 17 may be the same as the grass mat in which an artificial turf is formed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. An apparatus for correcting a head-up phenomenon during a golf swing, the apparatus comprising:

an operation unit which beforehand sets a maximum of a swing speed of a club, a lifting position of a golf ball, and a lifting interval and a lifting time of a golf ball by operating a button;

a swing speed/swing range detection unit which senses a golf club being swung to detect a velocity of the golf club and senses whether the golf club proceeds to a target tee to detect a motion of the golf club;

a golf-ball sensing unit which senses whether a golf ball is placed on a tee;

a control unit which compares the maximum of the swing speed set by the operation unit with a real swing speed of the golf club detected by the swing speed/swing range detection unit, outputs a moving signal of a lift driving unit, a moving signal of a golf-ball locking unit and a lifting interval and an ascending time signal of a golf ball depending on a predetermined value or a random value if the real swing speed is equal to or higher than the maximum of the swing velocity, and make an ascending golf ball descend if a swing range of a real golf club detected by the swing speed/swing range detection unit gets out of a set range of an up, down, left and right direction of a target tee;

the lift driving unit which makes the golf-ball locking unit ascend or descend according to a signal transferred from the control unit;

the golf-ball locking unit which suctions a golf ball to prevent the ascending golf ball from falling; and a power supply unit which supplies power to each of the units.

2. The apparatus of claim 1, wherein the operation unit comprises:

a swing-speed set button which increases or decreases the maximum of the swing speed and the swing range to transfer an increased-or-decreased set value to the control unit;

a height set button which adjusts a lift height of a golf ball to transfer an adjusted signal to the control unit;

a motion set button which sets the lifting interval and the lifting time of the golf ball randomly or regularly to transfer a set signal to the control unit; and a display means which displays a operated state and a motion state of the buttons.

3. The apparatus of claim 1, wherein the swing speed/swing range detection unit comprises:

a speedometer which senses a swing motion of a golf club at a front side or a rear side of a body of a golfer to calculate a velocity by using a distance by which a golf club moves and a time for which the golf club moves;

a position sensor which is placed in a rear side of a swing direction of the golf club and senses whether the golf club proceeds inside the set range of an up, down, left and right direction of a golf ball; and a sensing sensor senses whether or not the golfer is coming into a position of the operation unit or a position for training or not.

4. The apparatus of claim 1, wherein the golf-ball sensing unit is a proximity sensor which is placed in one side of the tee.

5. The apparatus of claim 1, wherein the golf-ball sensing unit is an illuminance sensor which senses a change of a light depending on an existence of the golf ball on the tee to sense whether the golf ball is laid on the tee or not.

6. The apparatus of claim 1, wherein the control unit is a microprocessor and a program built in a microprocessor which comprises:

a comparative unit which compares the maximum of the swing speed set by the operation unit with a real swing speed of the golf club detected by the swing speed/swing range detection unit;

a set processing unit which outputs an moving signal of a golf-ball locking unit depending on a lifting interval and a lifting time of the golf ball, the lifting interval and the lifting time being set by the operation unit, and gathers detection signals of the comparative unit to output a moving signal beforehand set for corresponding to the gathered detection signal; and a driver which outputs a moving signal of the lift driving unit and the golf-ball locking unit according to a signal outputted from the comparative unit.

7. The apparatus of claim 1, wherein the lift driving unit comprises:

a motor which rotates forward and backward according to a control signal transferred from the control unit;

a lifting means which moves forward and backward according to a rotation of the motor in the state that the lifting means forms a closed path by being connected to a path set part coupled to a rotational shaft of the motor and to another path set part located at one position or two path set part located at two position vertically to a ground;

a lift support part which is connected to both sides of a bracket, which is fixed in a side of a vertical and straight path of the lifting means by a shaft, at certain intervals;

an operation support part which is connected to both sides of a bracket, which is placed in a side direction of the lift support part, at certain interval;

an operation hinge which is coupled to a lower portion of the golf-ball locking unit by a shaft; and an operation link, one end of which is formed integrally with the operation hinge or connected to the operation hinge, a middle portion of which passes through the lift support part and is supported by the lift support part, the other end of which passes through the operation support part and is supported by the operation support part and which is formed in a boar shape or a bar shape.

8. The apparatus of claim 7, wherein the motor rotates forward and backward according to a signal outputted from the control unit, the path set part is a pulley, the lifting means a timing belt, the lift support part comprises a shaft fixed at a side of a path, which is parallel with a vertical and straight path of the lifting means, the path being a lift path of the golf-ball locking unit, at certain intervals, a bracket formed in one end portion of the shaft, a through hole being formed in a center portion of the bracket, and a pair of bearings coupled to both sides of the bracket at certain intervals, the operation support part comprises a shaft fixed to a upper portion of a wall in which the motor is fixed, a bracket formed in one end portion of the shaft, a through hole being formed in a center portion of the bracket, and a pair of bearings coupled to both sides of the bracket at certain intervals, and the operation hinge is any one of a pin, a ring and a bearing which are formed in one end portion of the operation link.

9. The apparatus of claim 1, wherein the golf-ball locking unit comprises:

a guide rail which is mounted on a wall vertically to a ground;

a bracket which is guided by the guide rail to ascend or descend by an ascending force or a descending force transferred from the lift driving unit;

a center pass-shaped tee which is fixed to an upper portion of the bracket; and a vacuum which is connected to a lower portion of the tee through a hose and suctions the outside air through a center through hole formed in a center portion of the tee, the outside air being suctioned from a side in which the golf ball is placed.

10. The apparatus of claim 1, wherein the lift driving unit comprises:

a spur gear which is rotated by a motor; and a rack gear which is mounted vertically to a ground in one side of the golf-ball locking unit and meshes with the spur gear.

11. The apparatus of claim 1, wherein the lift driving unit is a solenoid which generates a movement by using a current as a power and is used as an electro-dynamics apparatus.

* * * * *